US011538446B2

(12) United States Patent
Behn

(10) Patent No.: US 11,538,446 B2
(45) Date of Patent: Dec. 27, 2022

(54) ADJUSTABLE LENGTH BARREL WITH HAPTIC FEEDBACK FOR MUSICAL INSTRUMENT

(71) Applicant: BBSR Holdings, LLC, Edmond, OK (US)

(72) Inventor: Bradford Behn, Edmond, OK (US)

(73) Assignee: BBSR Holdings, LLC, Edmond, OK (US)

( * ) Notice: Subject to any disclaimer, the term of this patent is extended or adjusted under 35 U.S.C. 154(b) by 66 days.

(21) Appl. No.: 17/069,817

(22) Filed: Oct. 13, 2020

(65) Prior Publication Data

US 2022/0114991 A1 Apr. 14, 2022

(51) Int. Cl.
*G10D 9/01* (2020.01)
*G10D 7/066* (2020.01)

(52) U.S. Cl.
CPC ..... *G10D 9/01* (2020.02); *G10D 7/066* (2013.01)

(58) Field of Classification Search
CPC ..... G10D 9/01; G10D 7/066; G10D 9/00
See application file for complete search history.

(56) References Cited

U.S. PATENT DOCUMENTS 5,291,817 A * 3/1994 Smith ..... G10D 9/01 84/386

* cited by examiner

*Primary Examiner* — Kimberly R Lockett
(74) *Attorney, Agent, or Firm* — Crowe & Dunlevy, P.C.

(57) ABSTRACT

A barrel for a musical instrument is disclosed herein. The barrel includes a top section, a bottom section, an adjustment ring and a bore through the center. The barrel and bore length are configured to be adjusted with the adjustment ring. The barrel may include haptic features which provide feedback to a user regarding adjustments to the length of the bore and barrel. A trilobe socket and trilobe plug may be included and are configured to connect to prevent the barrel from slipping when manipulated and provide structural support. A tapered bore and bore choke provide additional structural stability and acoustic flexibility to the barrel.

20 Claims, 17 Drawing Sheets

FIG. 5a
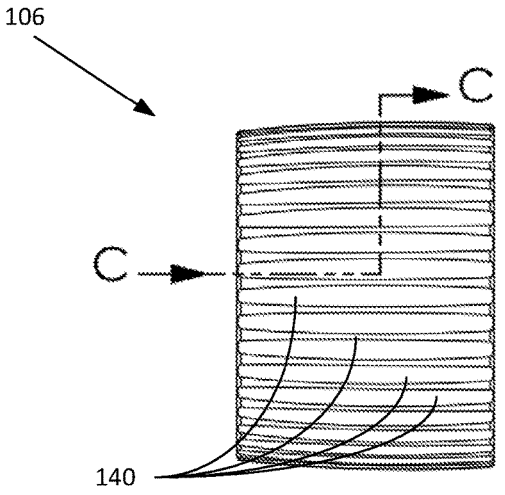
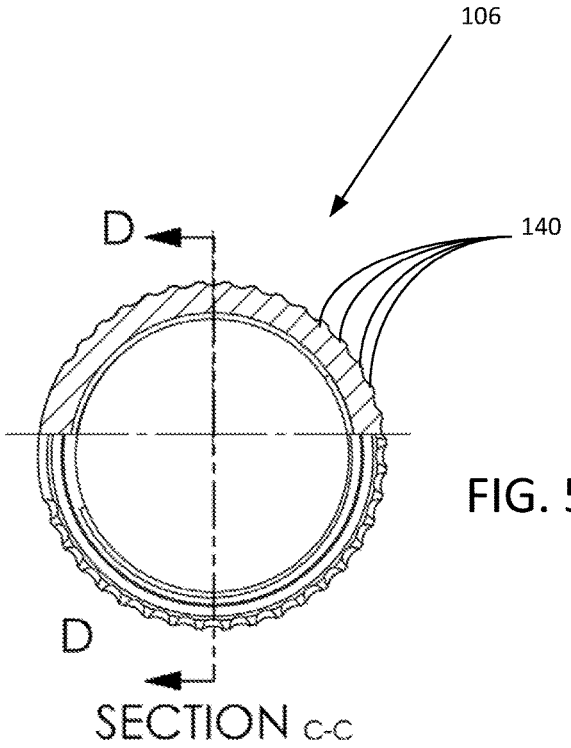
FIG. 5b
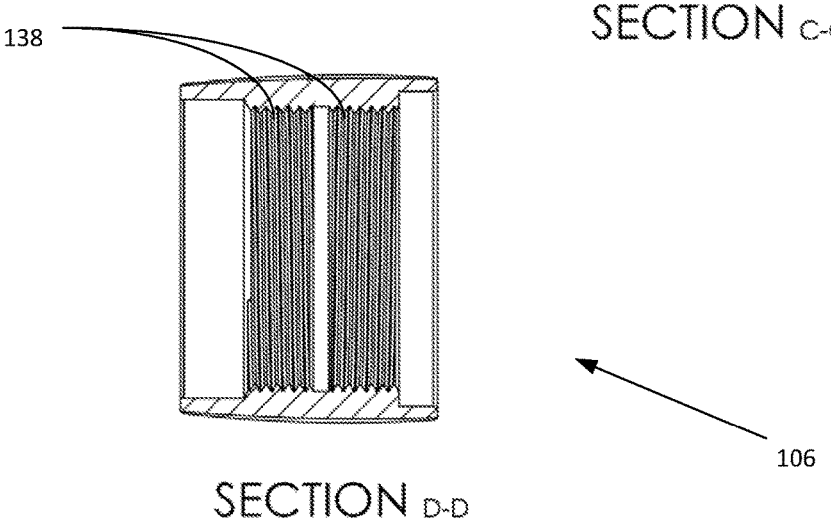
FIG. 5c

ADJUSTABLE LENGTH BARREL WITH HAPTIC FEEDBACK FOR MUSICAL INSTRUMENT

FIELD OF THE INVENTION

This invention relates generally to a barrel for a musical instrument, and more particularly, but not by way of limitation, to an adjustable length barrel with haptic feedback.

BACKGROUND

A clarinet generally includes five separable parts: a mouthpiece, barrel joint, upper joint, lower joint and bell. The barrel joint or barrel is the part of the clarinet that connects the mouthpiece to the rest of the body and specifically the upper joint. The barrel directs the sound through the instrument and affects the quality of sound. Due to the design of the clarinet and barrel, the pitch of the instrument is fairly temperature-sensitive. In some clarinets the barrel can be used to tune the clarinet, either through adjustments to the barrel, changes in the barrel's position, or replacement of the barrel. Compensation for pitch variation and tuning can also be effectuated by pulling out the barrel and thereby increasing the clarinet's length. Some clarinets will have multiple interchangeable barrels whose lengths vary slightly to change the pitch produced by the clarinet. Some clarinets may also have a means to adjust the barrel length to tune the clarinet.

The ability to tune a clarinet through these mechanisms is beneficial in various settings. For instance when a number of musicians are playing together, it is necessary to tune clarinets to other instruments. In addition, the pitch of a given note played by a specific clarinet can depend upon instrument-specific factors and environmental factors, such as the ambient temperature. The ambient temperature can raise or lower the temperature of the clarinet. The temperature of the clarinet may also rise through playing the instrument, or lower when a musician changes instruments or stops playing for an interval during a musical piece. In these instances, the pitch of a given note will rise as the temperature of the clarinet increases, and the pitch of a given note will lower as the temperature of the clarinet decreases. When the pitch is changed in this manner it is necessary to retune the clarinet to achieve the desired pitch.

While it is possible to retune clarinets through adjusting the barrel, changing the barrel's position, or replacing the barrel, these current methods of retuning have drawbacks. For instance the movement of the barrel's position only provides limited adjustments and replacing the barrel requires extra barrels to be on hand and time to change out the barrel. Current methods of adjusting the barrel are also limited. Current methods of adjusting the barrel may employ a thumbwheel on the barrel which allows the barrel to be inadvertently adjusted during playing. Current adjustable barrels also are not sufficiently accurate and the changes to the barrel length are not readily apparent without measurement or inspection. There is, therefore, a need for an improved adjustable barrel with the ability to fine tune a clarinet without visual inspection and with a reduced risk of inadvertent changes in tuning while manipulating the clarinet. It is to these and other objectives that the present invention is directed.

SUMMARY OF THE INVENTION

In general, the invention relates to a barrel for a musical instrument. The barrel includes a top section, a bottom section, an adjustment ring joining the two sections and a bore. The barrel is designed to be incorporated into a clarinet or other similar instrument between a mouthpiece and an upper joint. The length of the barrel and the bore in the barrel can be adjusted by manipulating the adjustment ring. The manipulation of the adjustment ring either draws the top section and bottom section together shortening the barrel or draws the two sections apart lengthening the barrel. Inside the bore haptic features such as a plurality of haptic bumps and a haptic o-ring protuberance interact when the barrel is lengthened or shortened to give haptic feedback regarding the length of the barrel and the bore to the user manipulating the adjustment ring. This haptic feedback signals set changes in the length of the barrel allowing the user to easily make adjustments. When the barrel is manipulated, fitted components such as trilobular features in the barrel prevent the joined bottom section and top section from twisting or slipping. A tapered bore allows for improved intonation and abuts a bore choke when the barrel is at its shortest length to provide tonal core and stability to the barrel. A large adjustment ring allows for easy access, fitted with deep knurls for superior grip.

BRIEF DESCRIPTION OF THE DRAWINGS

FIG. 5*a* is a side view of an adjustment ring constructed in accordance with an exemplary embodiment.

FIG. 5*b* is top-down partial cross sectional view along plane C-C of the adjustment ring of FIG. 5*a*.

FIG. 5*c* is side cross sectional view along plane D-D of the adjustment ring of FIG. 5*a*.

WRITTEN DESCRIPTION

In exemplary embodiments, an adjustable length barrel, configured to be incorporated into a clarinet between a mouthpiece and an upper joint, includes two sections which are secured together by a ring. The two sections are configured to be joined together and create a continuous bore through the barrel. The ring is configured to move the two sections closer together or further apart while holding the two sections as a joined assembly. The changes in length to the barrel allow for fine tuning of a clarinet. Sealing rings between the two sections seal the internal bore during manipulation. In some embodiments the ring has external textures. In other embodiments the rings has a protuberant shape to further increase grip.

The two sections are held stable with corresponding male and female couplings which prevent the two sections from inadvertently turning or slipping while still allowing length adjustments. In some embodiments the couplings have a rounded trilobular shape. In some embodiments the internal bore is tapered and interacts with a choke to provide acoustic stability. Haptic features incorporated into the two sections provide feedback to users manipulating the barrel to change its length. In some embodiments the haptic features consist of a rubberized ring and ridges in the internal bore walls which create haptic moments. In some embodiments the haptic moments consist of audible sounds when a certain change in length in the barrel is achieved. In other embodiments the haptic moments consist of an increase in resistance to manipulation of the ring and barrel length.

Figure 1:
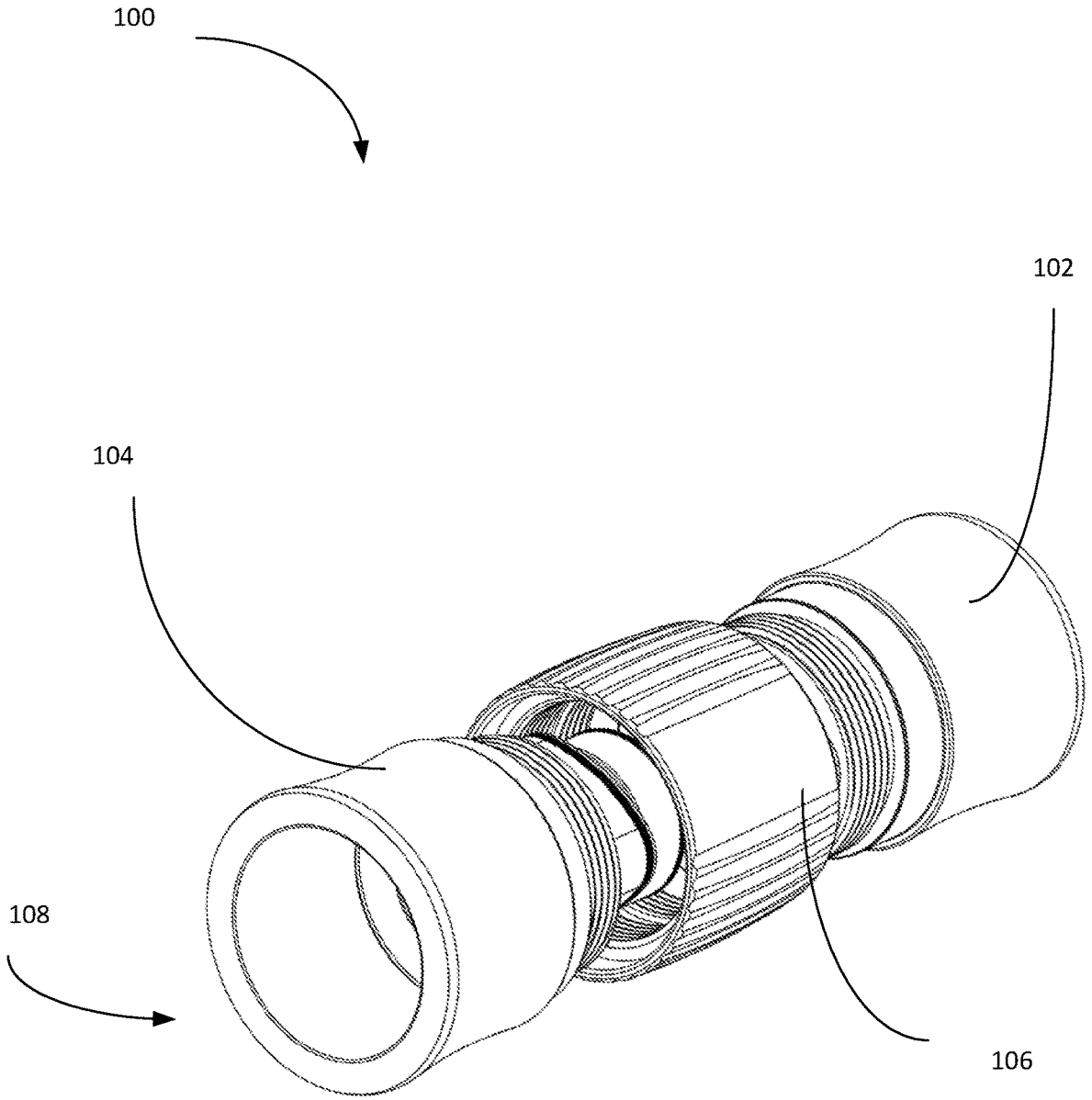
FIG. 1 is a partially exploded view of a barrel constructed in accordance with an exemplary embodiment.
Figure 2A:
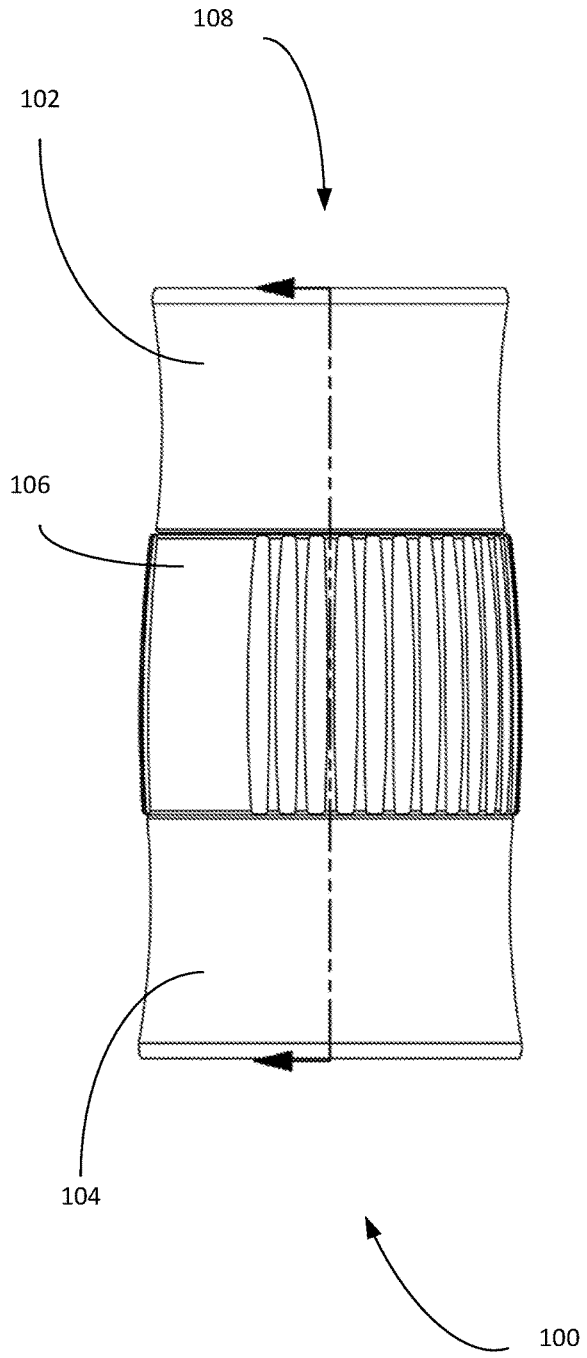
FIG. 2*a* is a side view of an assembled barrel constructed in accordance with an exemplary embodiment.
Figure 2B:
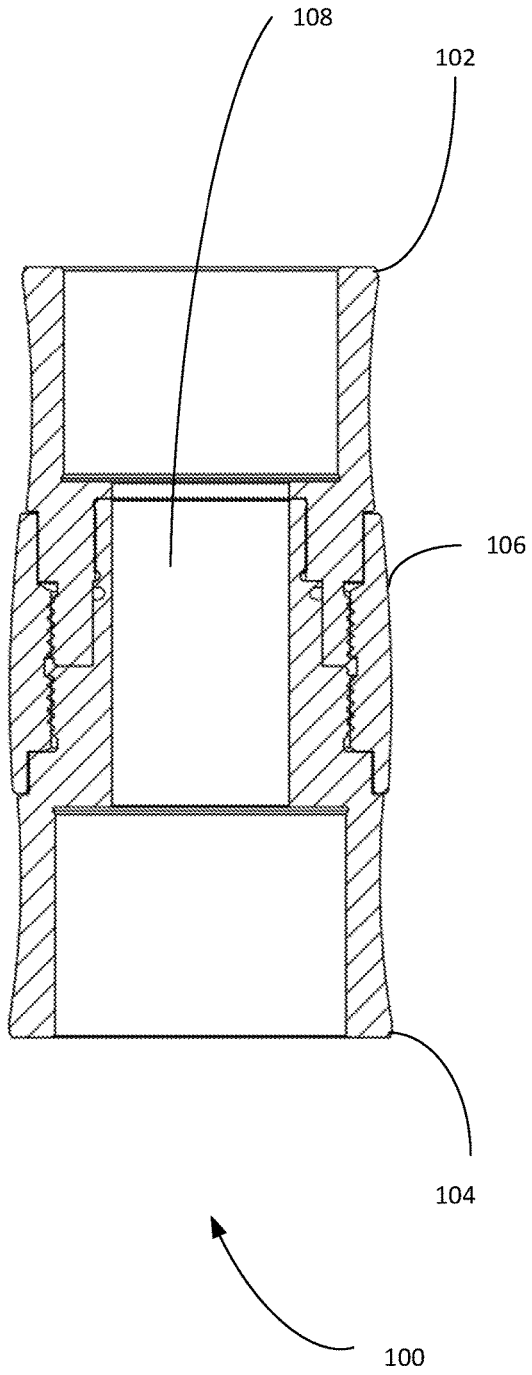
FIG. 2*b* is a cross sectional view of the barrel of FIG. 2*a*.

Referring now to FIGS. 1, 2*a*, and 2*b*, shown therein are views of a barrel 100 constructed in accordance with an exemplary embodiment, with FIG. 1 depicting a partially exploded perspective and FIG. 2*b* depicting a cross section of the barrel. In this embodiment the barrel 100 includes a top section 102, a bottom section 104, an adjustment ring 106 joining the two sections, and a bore 108. The barrel 100 is designed to be incorporated into a clarinet between a mouthpiece and an upper clarinet joint. The length of the barrel 100 and the bore 108 in the barrel 100 can be adjusted by manipulating the adjustment ring 106. The manipulation of the adjustment ring 106 either draws the top section 102 and bottom section 104 together shortening the barrel 100 or pulls the two sections apart lengthening the barrel 100. This lengthening and shortening of the barrel 100 and the bore 108 within the barrel 100 is used to tune a clarinet.

Figure 3A:
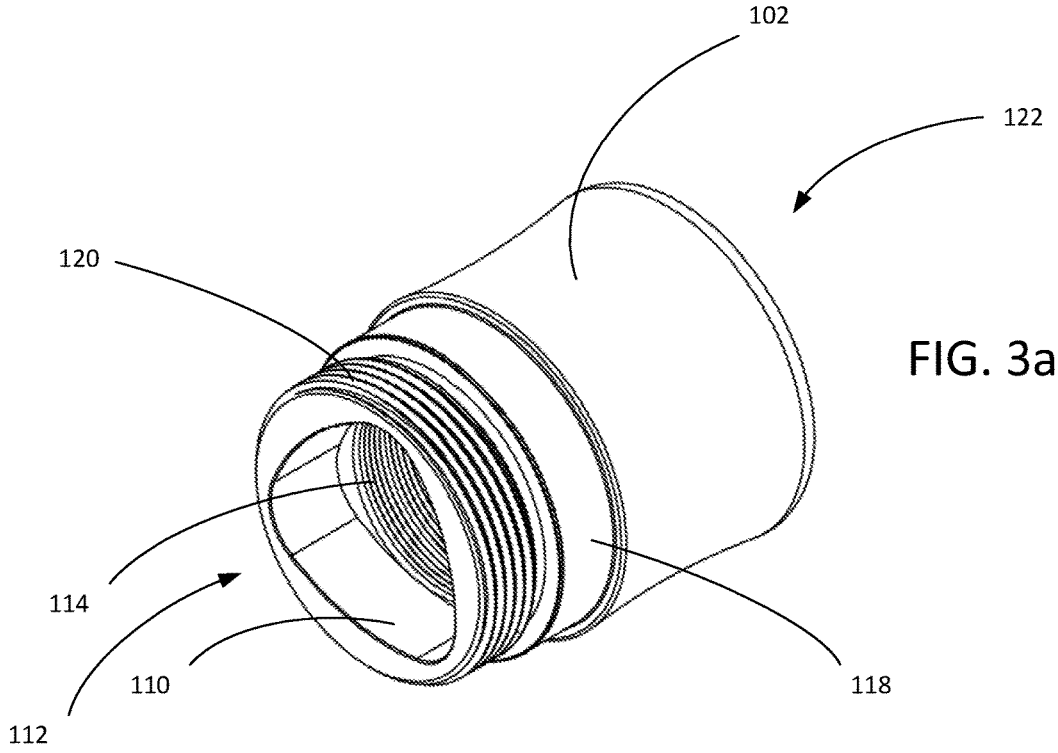
FIG. 3*a* is a perspective view of a top section constructed in accordance with an exemplary embodiment.
Figure 3B:
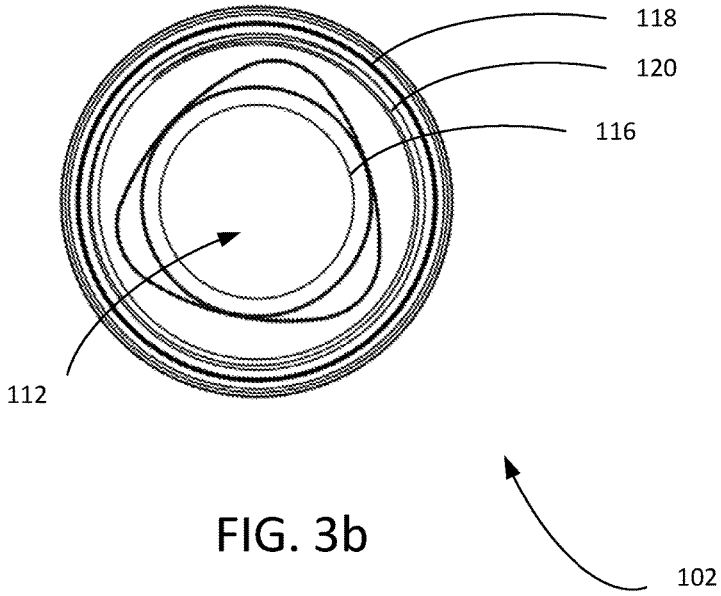
FIG. 3*b* is bottom-up view of the top section of FIG. 3*a*.

Turing now to FIGS. 3*a* and 3*b*, shown therein is a perspective view and a bottom view of the top section 102. The top section 102 of the barrel 100 is designed to be connected to a clarinet mouthpiece. In the present embodiment the top section 102 includes a trilobe socket 110, a top section bore 112, a plurality of haptic bumps 114, and a bore choke 116. These features are integrated into the internal walls of the top section 102. The exterior of the top section 102 is a mostly smooth and rounded surface with a recessed collar 118 and further recessed adjustment ring threading 120. This collar and threading are used to connect and tighten the top section 102 to the bottom section 104 with the adjustment ring 106.

The portion of the top section 102 which is configured to connect to a clarinet mouthpiece includes large opening 122 which leads to the top section bore 112. The top section bore 112 is narrower than this large opening 122. The top section bore 112 forms a portion of the bore 108 that runs the length of the inside of the assembled barrel 100. The bore choke 116 is located within the top section bore 112. The bore choke 116 narrows a short section of the top section bore 112. In the present embodiment the bore choke 116 narrows the top section bore 112 by extending into the bore 108 for a short section of the top section bore 112, creating a short portion of the top section bore 112 with a smaller diameter. The trilobe socket 110 is located at the opposite end of the top section 102 from the large opening 122 and is also incorporated into the interior walls of the top section 102. The trilobe socket 110 has a larger opening than the bore 108 and is generally a noncircular shape. In the present embodiment the trilobe socket 110 is configured in a trilobular shape. In other embodiments the trilobe socket 110 may be configured in other noncircular shapes. The plurality of haptic bumps 114 are integrated into the interior walls of the top section 102 and located between the bore choke 116 and the trilobe socket 110.

Figure 4A:
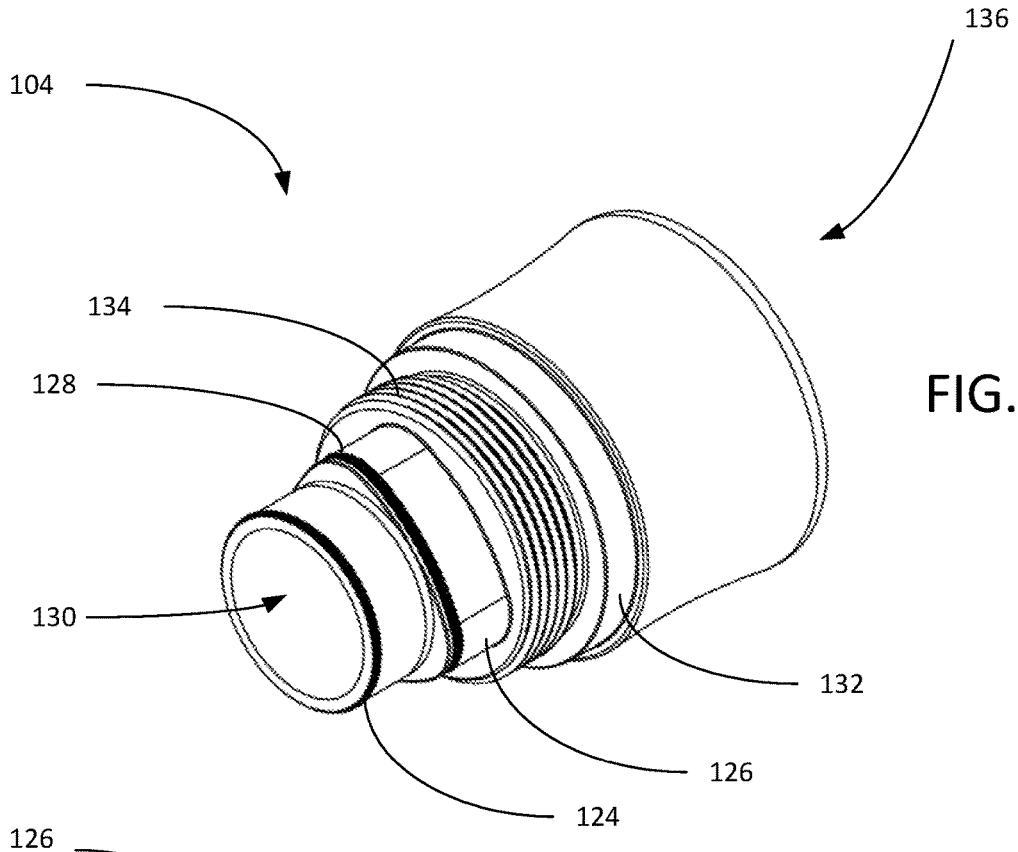
FIG. 4*a* is a perspective view of a bottom section constructed in accordance with an exemplary embodiment.
Figure 4B:
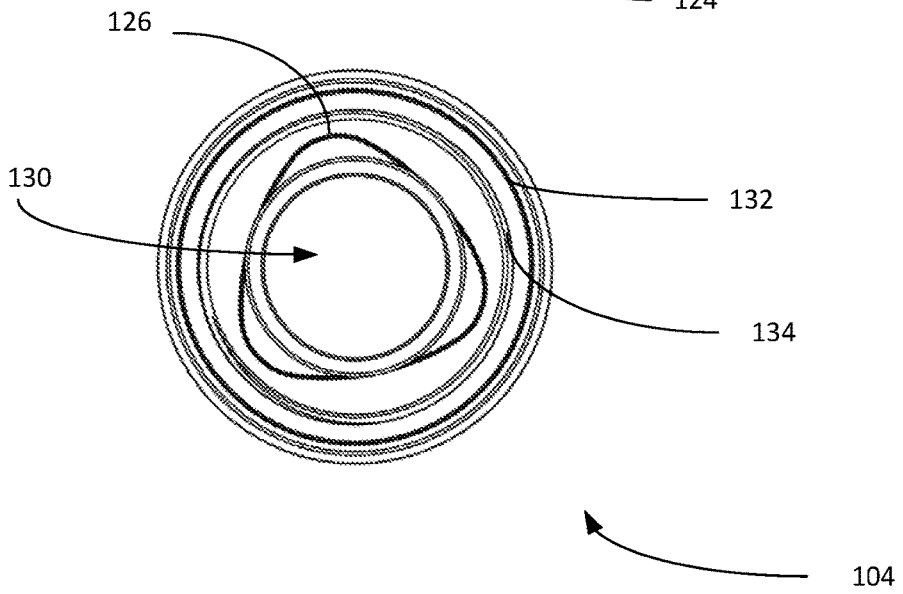
FIG. 4*b* is top-down view of the bottom section of FIG. 4*a*.

Turing now to FIGS. 4*a* and 4*b* shown therein is a perspective view and top view of a bottom section 104. The bottom section 104 of the barrel 100 is designed to be connected to a clarinet upper joint. In the present embodiment the bottom section 104 includes a haptic o-ring 124, a trilobe plug 126, a trilobe seal ring 128, and a bottom section bore 130. The trilobe plug 126 is integrated into the exterior of the bottom section 104 and is configured in a trilobular shape which can be fitted into the trilobe socket 110 of the top section 102. The trilobe seal ring 128 is fitted onto the exterior surface of the trilobe plug 126. The exterior surface of the bottom section 104 has a smooth and rounded surface with a recessed collar 132 and further recessed adjustment ring threading 134 which mirror those of the top section 102.

The portion of the bottom section 104 which is configured to connect to a clarinet upper joint has a large opening 136 which leads to the bottom section bore 130. The bottom section bore 130 is a slightly conical cavity that runs through the bottom section 104 and extends outward from the trilobe plug 126. The haptic o-ring 124 is fitted onto the exterior surface of the portion of the bottom section bore 130 which extends outward from the trilobe plug 126. When the barrel 100 is assembled the top section bore 112 in conjunction with the bottom section bore 130 forms the bore 108 that runs the length of the inside of the barrel 100. In the present embodiment the bottom section bore 130 has a variable internal circumference which tapers from 0.585 inches at the top to 0.570 inches at the bottom. In other embodiments the internal circumference of the bottom section 104 may taper to other dimensions. Still in other embodiments the internal circumference of the bottom section bore 130 may be designed as non-variable.

Turning now to FIGS. 5*a*, 5*b*, and 5*c* shown there is a side view, partial cross section top view and a cross sectional side view of an adjustment ring 106, respectively. The adjustment ring 106 is a hollow cylinder with internal threading 138 that is used to secure the bottom section 104 to the top section 102 and to adjust the barrel 100 and length of the bore 108. The internal threading 138 is designed to connect to the adjustment ring threadings 134, 120 of the bottom section 104 and the top section 102. As the adjustment ring 106 is turned the interaction of the internal threading 138 of the adjustment ring 106 with the adjustment ring threadings 134, 120 of the bottom section 104 and top section 102 will move the top section 102 and bottom section 104 either closer together or further apart. The adjustment ring 106 is configured to fit over the recessed collars 118, 132 of the bottom section 104 and top section 102 and not extend onto the smooth external surfaces of the top section 102 and bottom section 104. In the present embodiment a plurality of knurls 140 which run laterally along the adjustment ring 106 are integrated into the external surface of the adjustment ring 106. In the present embodiment the adjustment ring 106 has a protuberant shape for ease of gripping and manipulation.

Figure 6A:
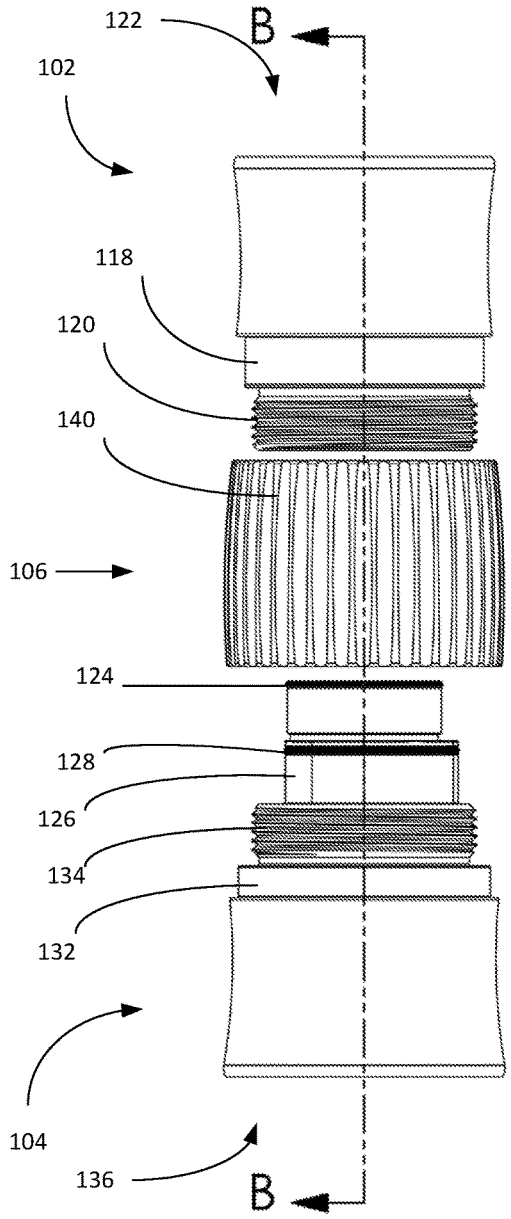
FIG. 6*a* is a partially exploded view of a barrel.
Figure 6B:
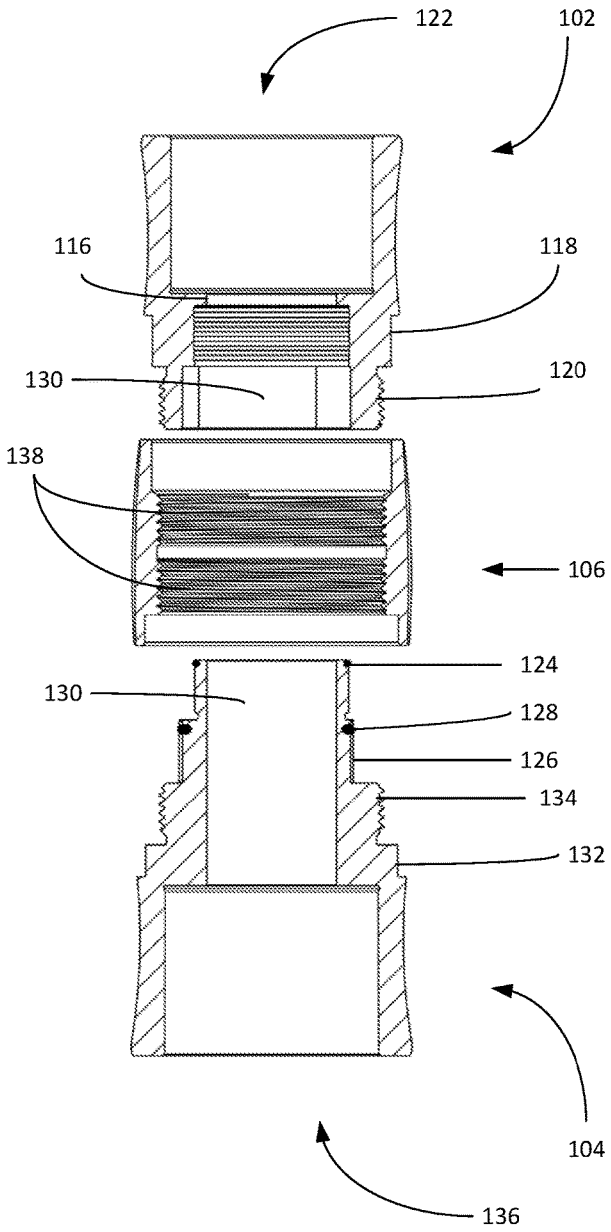
FIG. 6*b* is a partially exploded cross sectional view along plane B-B of FIG. 6*a*.

Turning now to FIGS. 6*a* and 6*b*, shown therein are partially exploded views of the barrel 100 constructed in accordance with the exemplary embodiment, with FIG. 6*b* depicting a partially exploded cross-sectional view. As shown and described above the bottom section 104 is configured to fit into the top section bore 112 with features integrated into the internal walls of the top section bore 112 aligning with features integrated into the external walls of the bottom section bore 130. This corresponding relationship of bottom section 104, top section 102 and adjustment ring 106 is apparent in FIGS. 6*a* and 6*b*. As is seen in FIGS. 6*a* and 6*b* the haptic o-ring 124 fitted onto the bottom section bore 130 is located at the top of the bottom section 104 and therefore it will be the first portion of the bottom section 104 to enter the top section bore 112. As the haptic o-ring 124 reaches the top section 102 it will engage the haptic bumps 114. This engagement will create haptic moments which are described in more detail below. The engagement of the haptic o-ring 124 with the plurality of haptic bumps 114 will only be possible if the trilobe socket 110 is aligned with the trilobe plug 126. These two features must be aligned or the misalignment will prevent the bottom section 104 and top section 102 from pairing due to the noncircular shape of the trilobe plug 126 and trilobe socket 110. The movement of the bottom section 104 and top section 102 is controlled by the adjustment ring 106. The adjustment ring internal threading 138 is configured to thread onto the adjustment ring threadings 134, 120 of the bottoms section 104 and top section 102. As the adjustment ring 106 is turned it pulls the top section 102 and bottom section 104 together or apart. As the top section 102 and bottom section 104 are adjusted the adjustment ring 106 slides over the recessed collars 118, 132.

Figure 7:
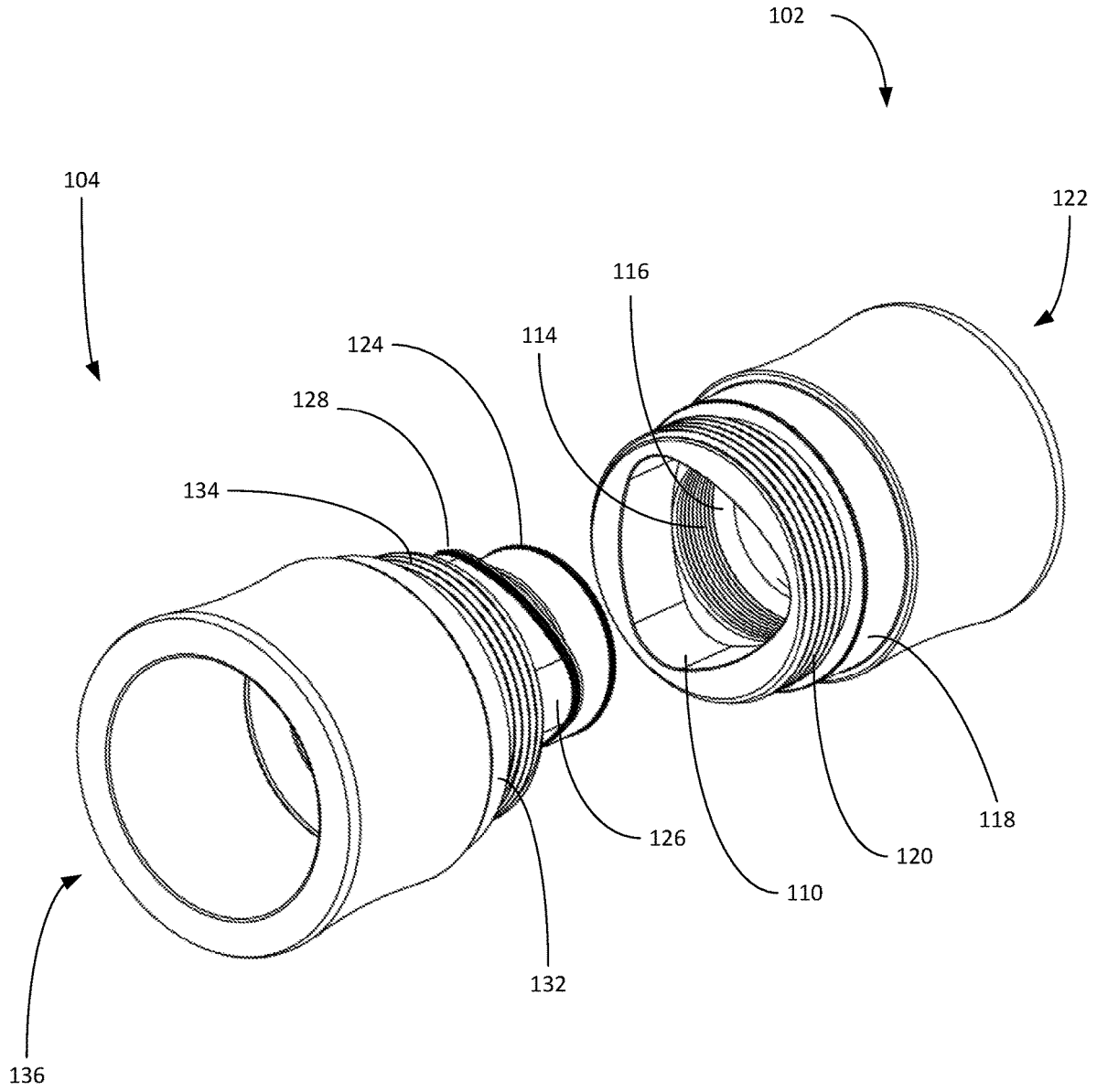
FIG. 7 is a perspective views of a bottom section and top section aligned to be connected.
Figure 8:
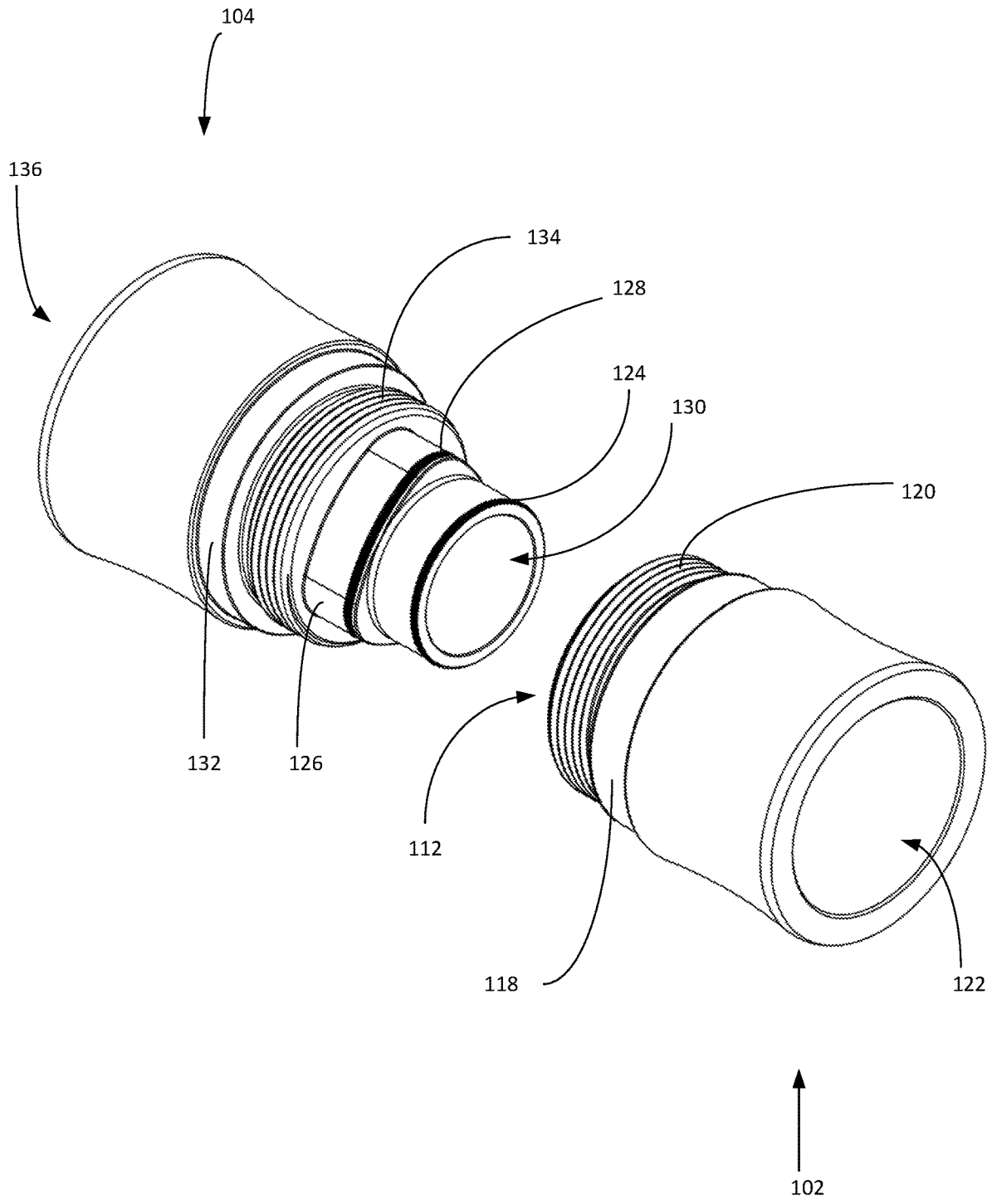
FIG. 8 is another perspective views of a bottom section and top section aligned to be connected.

Turning now to FIGS. 7 and 8, shown therein are perspective views of the bottom section 104 and top section 102 aligned to be connected. The two sections are configured such that the elements integrated into internal walls of the top section 102 fit to the elements integrated into the bottom section 104. This is apparent from the corresponding shapes of the trilobe plug 126 of the bottom section 104 and the trilobe socket 110 of the top section 102. When the trilobe plug 126 and trilobe socket 110 are aligned their trilobular shapes correspond and the top section 102 and the bottom section 104 can be fitted together. The paired trilobe socket 110 and trilobe plug 126 provide structural support to the assembled barrel 100. The trilobe socket 110 and trilobe plug 126 are fitted components that prevent the joined bottom section 104 and top section 102 twisting. This feature to prevent twisting is important to the proper function of the barrel 100, as when the barrel 100 is completely assembled, the adjustment ring 106 must be twisted to adjust the length of the barrel 100 and the bore 108. The trilobe plug 126 and the trilobe socket 110 prevent the bottom section 104 and top section 102 from also turning or slipping when the adjustment ring 106 is manipulated due to their noncircular shape and close fit. A trilobe seal ring 128 is fitted onto the trilobe plug 126 and seals the connection between the trilobe plug 126 and trilobe socket 110. It will be understood that in other embodiments other fitted components may be used or the trilobe plug 126 and trilobe socket 110 may be configured in other corresponding shapes to prevent slipping.

Figures 9A, 9B:
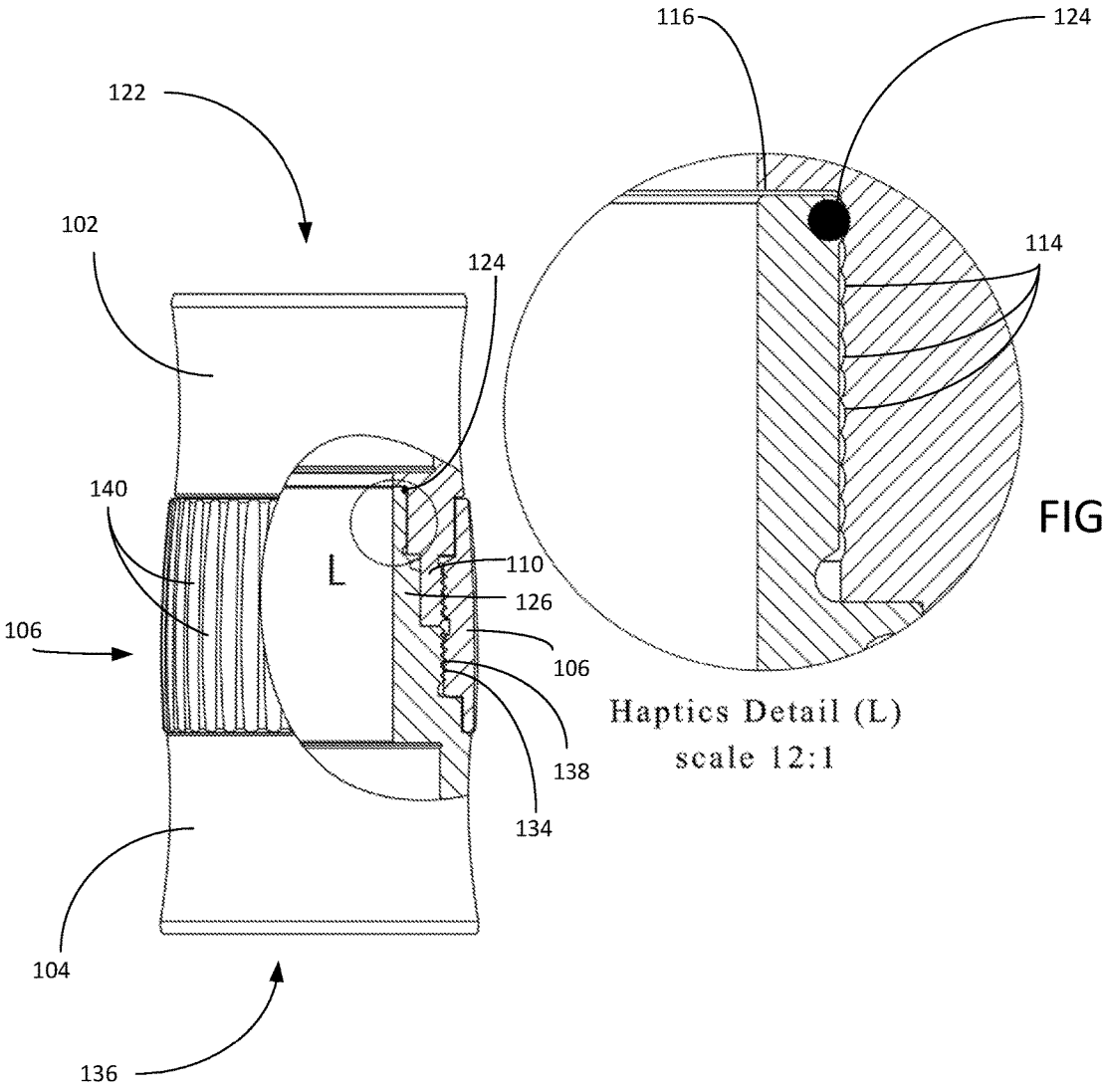
FIG. 9*a* is a barrel with a portion of the barrel cut away to show the cross sectional view.
FIG. 9*b* is a detail view of the cross sectional view of FIG. 9*a* showing the interaction between the plurality of haptic bumps and the haptic o-ring.

Turning now to FIGS. 9*a* and 9*b*, shown therein are views of the interaction between the plurality of haptic bumps 114 and haptic o-ring 124. The haptic bumps 114 and haptic o-ring 124 are configured to interact and produce haptic feedback when the connected bottom section 104 and top section 102 are moved apart or closer together. The haptic bumps 114 and haptic o-ring 124 are haptic features which provide haptic feedback regarding the length of the barrel 100 and bore 108. To connect the top section 102 and bottom section 104 the bottom section bore 130 is slid into the top section bore 112. As the bottom section 104 is slid into the top section 102, the haptic o-ring 124 fitted onto the external surface of the bottom section bore 130 will engage a first haptic bump in the plurality of haptic bumps 114 that are integrated into the internal surface of the top section bore 112. As the haptic o-ring 124 engages the haptic bump it creates a haptic moment or a resistance force to the bottom section bore 130 moving into the top section bore 112 followed by point of release as the bottom section bore 130 moves into the top section bore 112 a set amount and the haptic o-ring 124 settles into one of the haptic bumps 114. In some embodiments the haptic moment will produce an audible sound. These haptic moments are repeated as the bottom section 104 moves farther into the top section 102 for each haptic bump in the plurality of haptic bumps 114. The haptic moments will also occur as the bottom section 104 is pulled away from the top section 102.

When the barrel 100 is assembled the haptic moments are created as the adjustment ring 106 is turned. As the adjustment ring 106 is turned, at prescribed points in the ring's rotation a haptic moment is felt by the user. The sensitivity or resolution of the adjustment ring 106 can be calibrated so a haptic moment can occur at specific points of rotation such as every 90, 180, or 360 degrees as per the barrel's design preferences. Each haptic moment indicates a prescribed amount of lengthening or shortening in the barrel 100 as the top section 102 and bottom section 104 are moved closer together or farther apart. In some embodiments one haptic moment will occur for each one-quarter turn of the adjustment ring 106, and will equal a half of a millimeter of lengthening or shortening. When the adjustment ring 106 is turned one direction the barrel 100 lengthens, and when the adjustment ring 106 is turned the opposite direction the barrel 100 shortens. The combination of the haptic moments and the specific adjustments in length corresponding to specific rotations of the adjustment ring 106 allows a user to accurately adjust the length of the barrel 100 and the bore 108 without visually inspecting the adjustment ring 106 or measuring the barrel 100. It will be understood that in other embodiments the resolution of the adjustment ring 106 may correspond to a different degree of rotation.

Figure 10A:
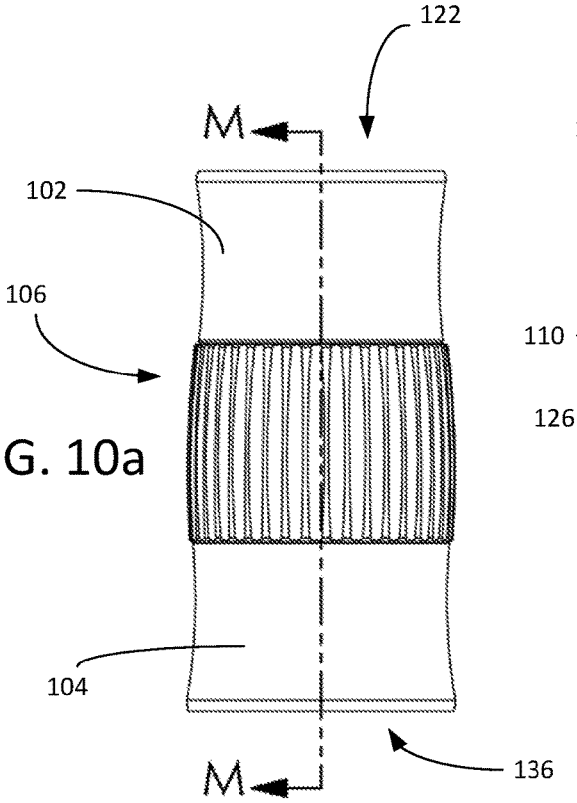
FIG. 10*a* is a side view of a barrel.
Figure 10B:
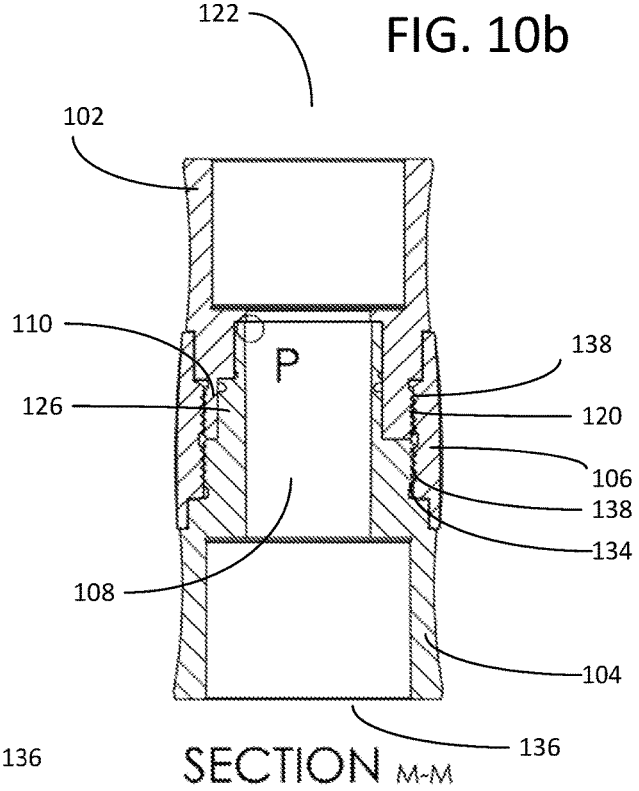
FIG. 10*b* is a cross sectional view of FIG. 10*a* along plane M-M.
Figure 10C:
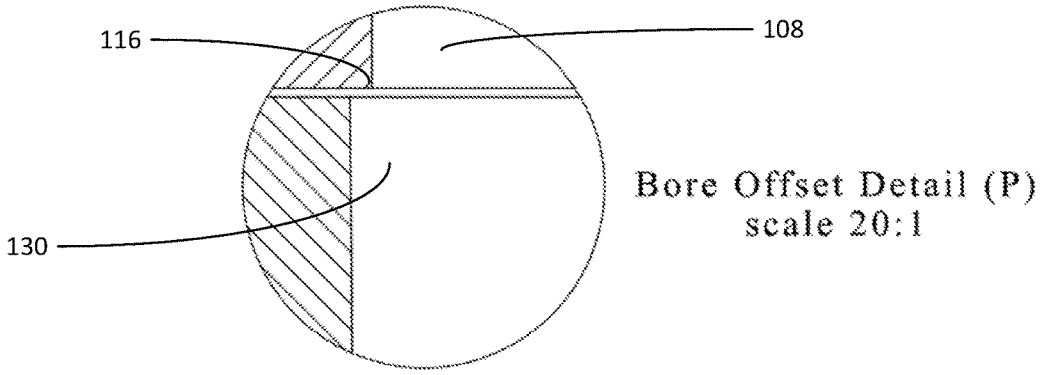
FIG. 10*c* is a detail view of the cross sectional view of FIG. 10*b* showing the offset bore thought the interaction between the bore choke and bottom section bore.
Figure 11:
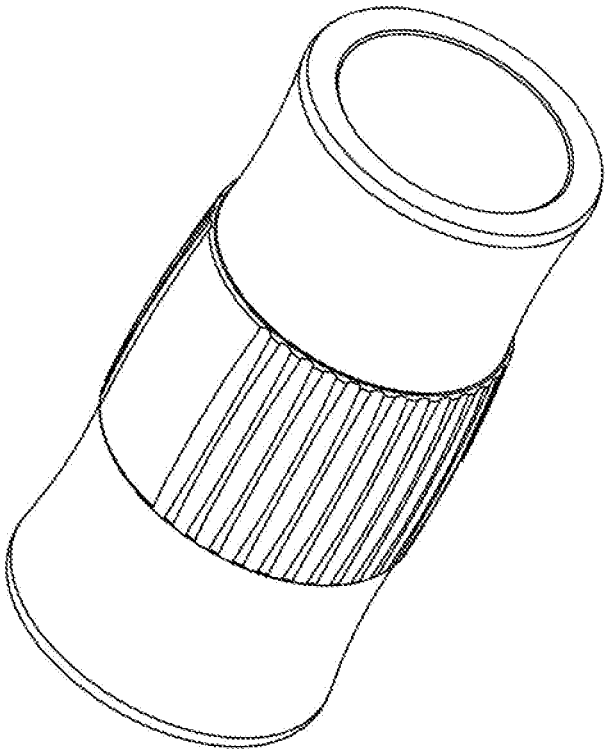
FIG. 11 is a perspective view of an assembled barrel.
Figure 12:
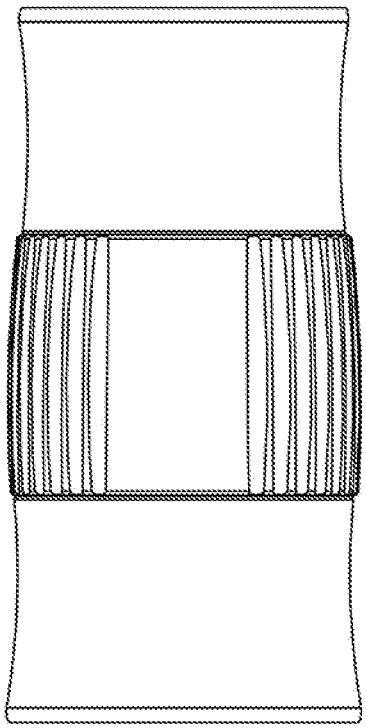
FIG. 12 is a front view of an assembled barrel.
Figure 13:
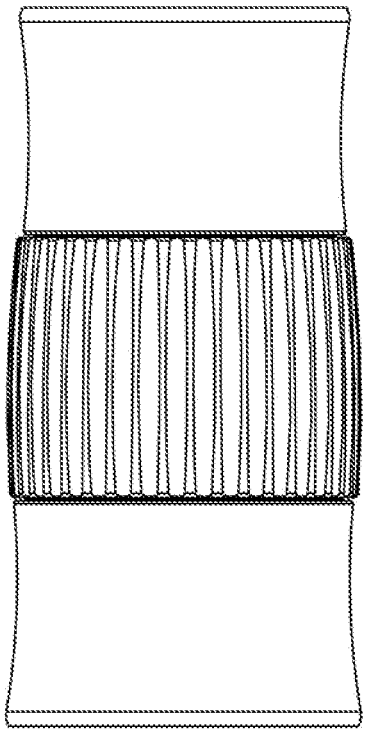
FIG. 13 is a back view of an assembled barrel.
Figure 14:
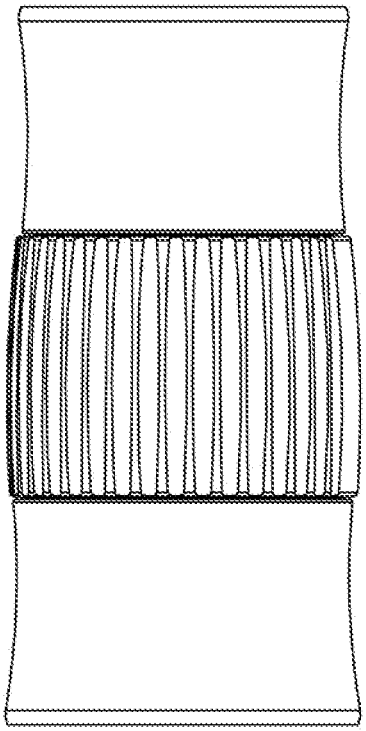
FIG. 14 is a left view of an assembled barrel.
Figure 15:
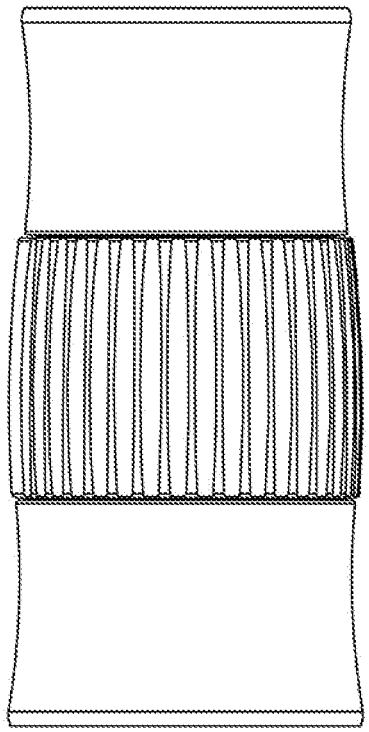
FIG. 15 is a right view of an assembled barrel.
Figure 16:
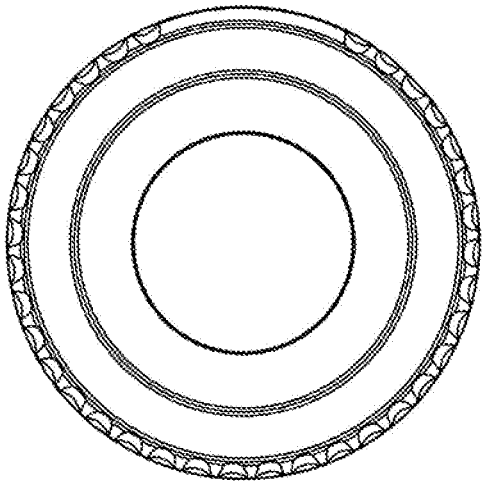
FIG. 16 is a top view of an assembled barrel.
Figure 17:
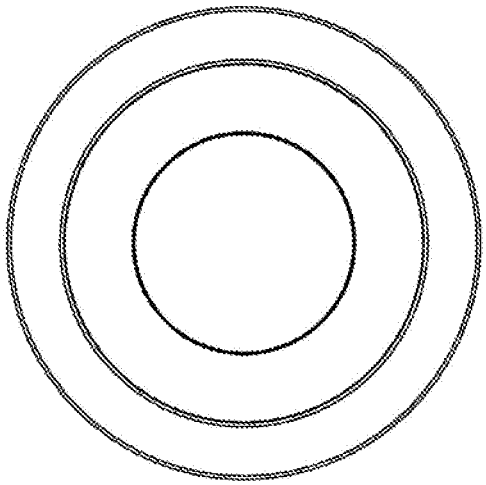
FIG. 17 is a bottom view of an assembled barrel.

Turning now to FIGS. 10*a*, 10*b*, and 10*c* a side view of the barrel 100, a cross-sectional view of the barrel 100, and a detail view of the bore 108 offset are shown respectively. In the present embodiment the top section bore 112 and bottom section bore 130 are configured such that when the barrel 100 is assembled and at its shortest length, the bottom section bore 130 will abut the bore choke 116. This contact between the bottom section bore 130 and the bore choke 116 can be seen in FIG. 10*b* and in the detail view of FIG. 10*c*. In particular the detail view of FIG. 10*c* shows that the bore choke 116 of the top section 102 extends further into the assembled barrel's bore 108 than the bottom section bore 130. This variance in the internal diameter of the barrel's bore 108 stops the bottom section 104 from extending farther into top section bore 112 and provides structural stability. The variance in the bore's 109 internal diameter is created by the bore choke 116 and by the internal diameter of the bottom section bore 130 being tapered away from the bore choke 116. This variance allows for more flexibility in the tuning of the barrel 100. In the exemplary embodiment the internal diameter of the bottom section bore 130 is tapered from 0.585 inches where the bottom section bore 130 abuts the bore choke 116 to 0.570 inches where the bottom section bore 130 opens to the large opening 136 of the bottom section 104. In the present embodiment the diameter of the bore choke 116 is also 0.570 inches and matches that of the bottom section bore 130 where the bottom section bore 130 meets the large opening 136 of the bottom section 104. In other embodiments the bottom section bore 130 may not have a taper. It will also be understood that in other embodiments the bore choke 116 and bottom section bore 130 may have different and non-corresponding measurements.

FIGS. 11-17 depict a perspective view, a front view, a back view, a left view, a right view and a top view, respectively of a preferred embodiment of an assembled barrel.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A barrel for a musical instrument, the barrel comprising:

a top section;

a bottom section;

a bore;

an adjustment ring, wherein the adjustment ring is configured to lengthen or shorten the barrel;

one or more haptic features, wherein the haptic features provide haptic feedback regarding changes in the length of the barrel, wherein the one or more haptic features comprises:

a plurality of haptic bumps; and a haptic o-ring; and one or more fitted components, wherein the fitted components prevent the bottom section and the top section from twisting.

2. The barrel of claim 1, wherein the haptic o-ring is configured to engage the plurality of haptic bumps and produce haptic moments.

3. The barrel of claim 2, further comprising:

a bottom section bore wherein the haptic o-ring is fitted onto the bottom section bore; and a top section bore, wherein the haptic bumps are integrated into the top section bore.

4. The barrel of claim 3, wherein each haptic moment corresponds to the barrel changing the same amount of length.

5. The barrel of claim 4, wherein the haptic moment comprises an audible sound.

6. The barrel of claim 4, wherein the haptic moment comprises increased resistance to the bottom section bore moving into the top section bore.

7. The barrel of claim 1, wherein the one or more fitted components comprises:

a trilobe plug; and a trilobe socket.

8. The barrel of claim 7, wherein the trilobe plug is integrated into the bottom section and the trilobe socket is integrated into the top section and wherein the trilobe plug and trilobe socket have a trilobular shape.

9. The barrel of claim 8, further comprising a trilobe seal ring between the trilobe socket and trilobe plug.

10. The barrel of claim 1, wherein the bore has a variable internal diameter along the length of the bore.

11. The barrel of claim 10, further comprising a bottom section bore and a top section bore.

12. The barrel of claim 11, wherein the top section bore comprises a bore choke.

13. The barrel of claim 12, wherein the inner diameter of the bottom section bore is tapered away from the bore choke.

14. The barrel of claim 13, wherein the bore choke and a tapered end of the bottom section bore have same inner diameter.

15. The barrel of claim 1, wherein the adjustment ring connects the bottom section and the top section.

16. The barrel of claim 15, wherein the adjustment ring connects the bottom section and top section using threaded connection, and wherein the length of the barrel is adjusted by turning the adjustment ring.

17. The barrel of claim 1, wherein the adjustment ring has a plurality of knurls.

18. The barrel of claim 1, wherein the top section, bottom section, and adjustment ring are separable elements.

19. An adjustable length barrel for a clarinet, the barrel comprising:

a top section configured to attach to a clarinet mouthpiece;

a bottom section configured to attach to an upper clarinet joint;

an adjustment ring configured to connect the top section and bottom section, wherein the adjustment ring is further configured to change the length of the barrel;

a bore configured to change in length as the barrel changes in length;

a trilobular fitting configured to prevent the connected top section and bottom section from rotating in relation to each other;

a tapered bore configured to abut a bore choke when the barrel is at its shortest length; and a plurality of haptic bumps configured to provide haptic feedback in response to changes in the length of the barrel.

20. A barrel for a musical instrument, the barrel comprising:

a top section;

a bottom section;

a bore;

an adjustment ring, wherein the adjustment ring is configured to lengthen or shorten the barrel;

one or more haptic features, wherein the haptic features provide haptic feedback regarding changes in the length of the barrel; and one or more fitted components, wherein the fitted components prevent the bottom section and the top section from twisting, wherein the one or more fitted components comprises:

a trilobe plug; and a trilobe socket.

* * * * *